US010011471B2

(12) United States Patent
Krueger et al.

(10) Patent No.: US 10,011,471 B2
(45) Date of Patent: Jul. 3, 2018

(54) APPARATUS AND METHOD FOR EMPTYING CONTAINERS, WITH CONTROL OF A DRIVE TORQUE

(71) Applicant: KRONES AG, Neutraubling (DE)

(72) Inventors: Jochen Krueger, Hagelstadt (DE); Rupert Meinzinger, Kirchroth (DE)

(73) Assignee: KRONES AG (DE)

( * ) Notice: Subject to any disclaimer, the term of this patent is extended or adjusted under 35 U.S.C. 154(b) by 97 days.

(21) Appl. No.: 14/914,020

(22) PCT Filed: Aug. 27, 2014

(86) PCT No.: PCT/EP2014/068198
§ 371 (c)(1),
(2) Date: Feb. 24, 2016

(87) PCT Pub. No.: WO2015/028525
PCT Pub. Date: Mar. 5, 2015

(65) Prior Publication Data

US 2016/0214849 A1 Jul. 28, 2016

(30) Foreign Application Priority Data

Aug. 27, 2013 (DE) ..... 10 2013 109 265

(51) Int. Cl.
*B65D 35/28* (2006.01)
*B67D 1/00* (2006.01)
(Continued)

(52) U.S. Cl.
CPC ..... *B67D 1/0001* (2013.01); *B67D 1/0004* (2013.01); *B67D 1/0884* (2013.01);
(Continued)

(58) Field of Classification Search
CPC .. B67D 1/0001; B67D 1/0004; B67D 1/0891; B67D 1/0892; B67D 1/0884; B67D 1/1243; B67D 7/0216
See application file for complete search history.

(56) References Cited

U.S. PATENT DOCUMENTS 5,918,767 A * 7/1999 McGill ..... A23G 3/28 222/105
6,131,766 A * 10/2000 King ..... B67D 7/0227 222/1
(Continued)

FOREIGN PATENT DOCUMENTS

CN 204417097 U 6/2014
CN 203877890 U 10/2014
(Continued)

OTHER PUBLICATIONS

Chinese Office Action—Application No. or patent No. 201310641503.2; dated Jul. 12, 2016; 5 pgs.
(Continued)

*Primary Examiner* — J. Casimer Jacyna
(74) *Attorney, Agent, or Firm* — Schmeiser, Olsen & Watts, LLP

(57) ABSTRACT

An apparatus is provided for emptying containers, including first and second holding devices which are suitable for holding first and second regions of containers that are to be emptied, wherein the second region is a distance from the first region, including a movement device which suitable for moving the first holding device towards the second holding device to compress the container located between the first holding device and the second holding device, and including a withdrawal device which has a flow connection to the interior of the container and via which liquid located in the container can be withdrawn as a result of compression of the container, including a drive device for driving the movement
(Continued)

device, and including a control device which controls the relative movement of one holding device relative to the other holding device as a function of an internal pressure inside the container.

8 Claims, 4 Drawing Sheets

(51) Int. Cl.
*B67D 1/08* (2006.01)
*B67D 1/12* (2006.01)

(52) U.S. Cl.
CPC ..... *B67D 1/0891* (2013.01); *B67D 1/125* (2013.01); *B67D 1/1243* (2013.01)

(56) References Cited

U.S. PATENT DOCUMENTS 6,932,237 B2 * 8/2005 Heymann ..... A61C 9/0026 222/1
9,597,706 B2 * 3/2017 Burns ..... B05C 17/00583
2006/0070470 A1 4/2006 McGill et al.
2012/0104020 A1 * 5/2012 Cur ..... B67D 1/0001 222/1
2013/0240562 A1 * 9/2013 Middleton ..... B65D 83/0077 222/103
2015/0053716 A1 * 2/2015 Meinzinger ..... B67D 3/0006 222/23

FOREIGN PATENT DOCUMENTS

DE 4416089 A1 10/1995
DE 102007054431 A1 5/2009
DE 102012101503 A1 8/2013
DE 102012101507 A1 8/2013
DE 202013005658 U1 6/2014

OTHER PUBLICATIONS

International Search Report; PCT/EP2014/068198; International Filing Date: Aug. 27, 2014; 2 pgs.
Chinese Office Action—Application No. or patent No. 201310641503.2; dated Dec. 23, 2015; 9 pgs.

* cited by examiner

APPARATUS AND METHOD FOR EMPTYING CONTAINERS, WITH CONTROL OF A DRIVE TORQUE

CROSS-REFERENCE TO RELATED APPLICATIONS

This application claims priority to PCT Application No. PCT/EP2014/068198, having a filing date of Aug. 27, 2014, based on DE 10 2013 109 265.9, having a filing date of Aug. 27, 2013, the entire contents of which are hereby incorporated by reference.

FIELD OF TECHNOLOGY

The following relates to an apparatus and a method for emptying containers. Various apparatuses and methods for emptying containers are known. For instance, it is known that the interior of a container is acted upon by gas in order thus to be able to withdraw the liquid from the container. Also known are apparatuses in which the containers are clamped between two holding devices and the container is squashed by moving these towards one another in order thus to be able to withdraw the liquid from the container. In the case of such apparatuses or dispensing systems, it is desirable to keep the pressure fairly constant during the dispensing in order firstly to be able to dispense the liquid, for example beer, with uniform pressure and in order on the other hand to keep the $CO_2$ content constant over the entire time period (from the first to the last dispensed glass). If the pressure in the container decreases, the dissolved $CO_2$ escapes from the beer into the headspace.

BACKGROUND

From the internal art and the unpublished document as of the foreign priority date of this application, DE 10 2012 101507 (now published on Aug. 29, 2013 as DE 10 2012 101507 A1 and Feb. 26, 2015 as US 20150053716 A1), it is known to measure the internal pressure in the container via suitable electric or mechanical sensors, for example on the container wall or also on the dispensing hose. If there is a drop below a certain pressure during the dispensing, the container is compressed again until the desired pressure is once again reached. It would also be possible to measure the pressure in the container or in the hose using a manometer (the measurement thus being carried out in contact with the product). The content of the disclosure of DE 10 2012 101 507, and in particular of the passages relating to the subjects of the dependent claims therein, is hereby also fully incorporated by way of reference into the subject matter of the present application.

In practice, however, this pressure measurement by means of sensors proves to be relatively difficult. In particular, pressure measurement by a test pin against the container wall would be relatively inaccurate and in particular also depends on the wall thickness of the container and the deformability of the container wall. Particularly in the case of plastic containers produced in a blow-moulding process, the wall thickness of the containers is not always uniform and may even fluctuate from container to container. The wall thickness also depends on the ambient conditions of a blow-moulding machine, and also on the plastic preforms used. An accurate measurement is therefore difficult or very complicated.

It is also known from the internal art of the applicant to measure the pressure within the container via a sleeve over the dispensing hose, in a manner similar to the procedure when measuring blood pressure. However, this method is also dependent on the hose material, that is to say in particular on the wall thickness, material and temperature thereof. Integrating in the hose a pressure sensor which makes contact with the product is also problematic when using disposable parts, for example disposable dispensing hoses. In this case, said sensor would have to be cleaned regularly.

SUMMARY

An aspect relates to a type of pressure measurement which is simplified in comparison to the known art, or a pressure-based regulation of the drive devices for such dispensing systems.

An apparatus according to embodiments of the invention for emptying containers comprises a first holding device which is suitable for holding a first region of a container that is to be emptied. The apparatus further comprises a second holding device which is suitable for holding a second region of the container that is to be emptied, wherein the second region is at a distance from the first region. Also provided is a movement device which is suitable for moving the first holding device towards the second holding device in order to compress the container located between the first holding device and the second holding device. The apparatus also comprises a withdrawal device which has and/or establishes a flow connection to the interior of the container and via which liquid located in the container can be withdrawn as a result of compression of the container. The apparatus further comprises a drive device which drives said movement device, and a control device which controls the relative movement of one holding device relative to the other holding device or the withdrawal of the liquid via the withdrawal device as a function of an internal pressure inside the container.

According to embodiments of the invention, the control device is configured in such a way that it controls the relative movement of one holding device relative to the other holding device as a function of a drive torque of the drive device, in particular a drive torque of the drive device acting on the movement device and in particular on at least one component of the movement device.

Advantageously, the control device has a detection device which detects a drive torque of the drive device acting on the movement device. The drive device can be controlled as a function of this detected drive torque. However, it would also be possible that an effect or further force generated by this drive torque is used to switch or to control the drive device.

It is therefore proposed according to embodiments of the invention that no longer is the internal pressure in the container measured directly, but rather a different variable is measured which is nevertheless directly linked to this internal pressure. Said drive torque of said drive device is namely a direct indication of the internal pressure in the container. In other words, a simple possibility is provided for determining very accurately the pressure in the container, namely via the torque with which a drive motor or a drive device compresses the container.

Since a relatively large torque is necessary in order to drive the drive device, for example spindles, of the dispensing system, a torque support may be provided for example on the drive device. In this case, the drive device may be screwed on since otherwise the drive device could rotate about the drive axle. Such a measurement has the advantage that no contact with the product is necessary and also no measurements are carried out on disposable parts.

However, it is pointed out that this detection device also need not necessarily detect absolute force values, but rather relative values may be sufficient, for example an increase in pressure or torque to a given value.

Preferably, the drive device is arranged on a movable carrier and the drive torque can be detected via a movement of said carrier and/or the control device is configured in such a way that it controls the relative movements of the holding devices towards one another as a function of a movement of the carrier.

For example, a force measuring device may be arranged on said movable carrier. If this carrier then moves on account of a change in the drive torque, this can be detected via the force measuring device.

Said carrier may thus be a torque support, in which for example a force sensor may be installed. The drive device, which in particular is an electric motor, is thus preferably mounted in a freely rotatable manner, and the carrier on which the drive device is mounted presses against a force sensor. The latter measures the necessary force for compressing the container. The pressure in the container can be measured and regulated via simple formulae and knowledge of the dispensing system itself (for example spindles, transmission ratios, lever length of the torque support and/or of the carrier, diameter of the container and the like).

If a given torque is exceeded, the drive device can be stopped. If there is a drop below a second (lower) torque (for example during the dispensing), the drive device starts again. Such force sensors preferably use the elastic deformation of spring elements and may operate for example by way of strain gauges, piezoelectrically or by way of electrical resistors, which change in the event of elastic elongation.

However, it would also be possible that the carrier on which the drive device is arranged actuates a switching device directly, so that the drive torque is not measured directly but for example the motor is switched on or off in reaction to an increased drive torque. In this case, it would be possible that the carrier, when loaded, compresses a spring having a defined spring constant. If the spring is compressed far enough, the carrier can press against a simple electric switch (push-button), which interrupts the power supply to the drive device. When the torque decreases again, because dispensing is taking place, the switch is released again and the motor rotates again. A suitable gearing is preferably arranged in the drive device, as a result of which the system is self-locking. In other words, even when the motor is without power, the pressure in the container does not push apart the two holding devices.

However, it would also be conceivable that the drive torque of the motor is detected directly (for example via a rotary encoder, current measuring devices and the like) and the control takes place as a function of this measured drive torque.

In a further advantageous embodiment, the movement device has a first drive spindle, the rotational movement of which brings about a movement of one holding device relative to the other holding device. This drive spindle may in this case bring about a very advantageous force reduction.

Preferably, the drive device is coupled to the first drive spindle via a force transmission means. This force transmission means may be for example a toothed belt, on which the drive device acts on one side and also the spindle(s) driven by the drive means act on the other side. In addition, a revolving chain means or the like could also be provided as force transmission means.

In a further advantageous embodiment, the detection device detects a force acting on the force transmission means. A torque of the drive device or of the motor is thus also determined indirectly.

In a further advantageous embodiment, the movement device has a second drive spindle, the rotational movement of which brings about a movement of one holding device relative to the other holding device. In this way, the applied forces can be better distributed on the container.

Advantageously, a rotational movement of the second drive spindle is coupled to a rotational movement of the first drive spindle. In particular, said rotational movements are coupled via the force transmission means and are preferably driven jointly.

In a further advantageous embodiment, a third drive spindle is also provided, the rotational movement of which brings about a movement of one holding device relative to the other holding device. In this embodiment, therefore, a total of three drive spindles are provided, which bring about the relative movement of the two holding devices relative to one another.

Advantageously, the first holding device is provided for holding a base region of the container and the second holding device is provided for holding a mouth region of the container. Advantageously, the holding devices are arranged in such a way that the container can be arranged upright therebetween with the mouth pointing upwards.

Furthermore, preferably at least one holding device has a stamp element which has a smaller cross-section than a main body of the container. In this way, the container can be emptied in such a way that one region of the container is rolled into a second region of the container.

In a further advantageous embodiment, the withdrawal device has a piercing device for piercing at least one wall of the container or a container cap of the container.

In this case, the withdrawal device is particularly preferably arranged in one of the two holding devices and in particular in the holding device which holds the mouth region of the container.

In a further advantageous embodiment, the apparatus has a switching device which switches the drive device as a function of a drive torque detected by the detection device and/or a torque applied by the drive device. The switching device thus also preferably causes the drive device to be switched on or off in reaction to an internal pressure inside the container.

This switching device may also be, for example, a regulator which regulates the drive device as a function of the measured drive torque. However, a mechanical switch or else a force sensor, the output signal of which serves to regulate or to switch on and off the drive device, would also be conceivable.

Embodiments of the invention also relates to a method for emptying containers, wherein a container is arranged between a first holding device, which holds a first predetermined region of the container, and a second holding device, which holds a second predetermined region of the container, and the first holding device and the second holding device are moved towards one another in order to compress the container arranged between said holding devices. According to embodiments of the invention, the movement of the holding devices towards one another is brought about by a drive device and is controlled as a function of a drive torque applied thereto by the drive device.

It is thus also proposed with regard to the method that the internal pressure in the container is not used directly as the basis for evaluation or reference for emptying the containers, but rather a variable resulting therefrom, namely the drive torque of a drive device.

Preferably, at least one force occurring in a force transmission train between the drive device and the holding device driven at least indirectly by said drive device is measured. However, it would also be possible to measure the drive torque directly, for example electronically.

BRIEF DESCRIPTION

Some of the embodiments will be described in detail, with reference to the following figures, wherein like designations denote like members, wherein:

FIGS. 1*a*-1*c* show three diagrams of an apparatus in different operating states;

Figure 5A:
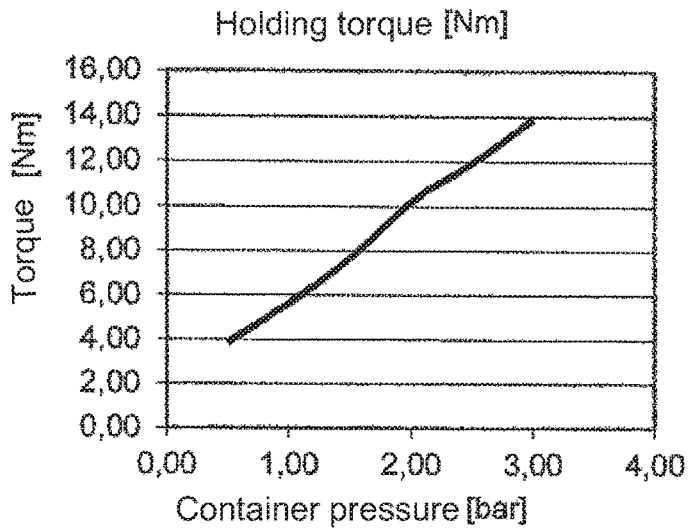
Figure 5B:
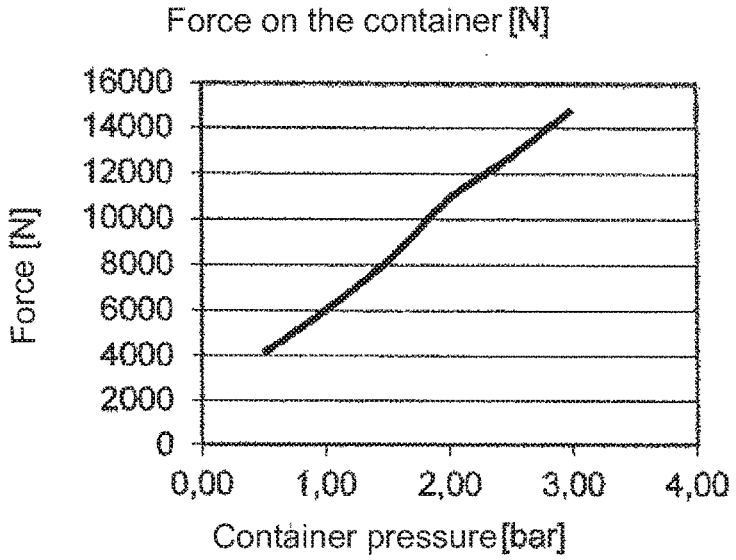

FIG. 5*a* shows a diagram to illustrate a relationship between a drive torque and a container pressure; and FIG. 5*b* shows a diagram to illustrate measurements of a relationship between a torque and a container pressure.

DETAILED DESCRIPTION

Figure 1A:
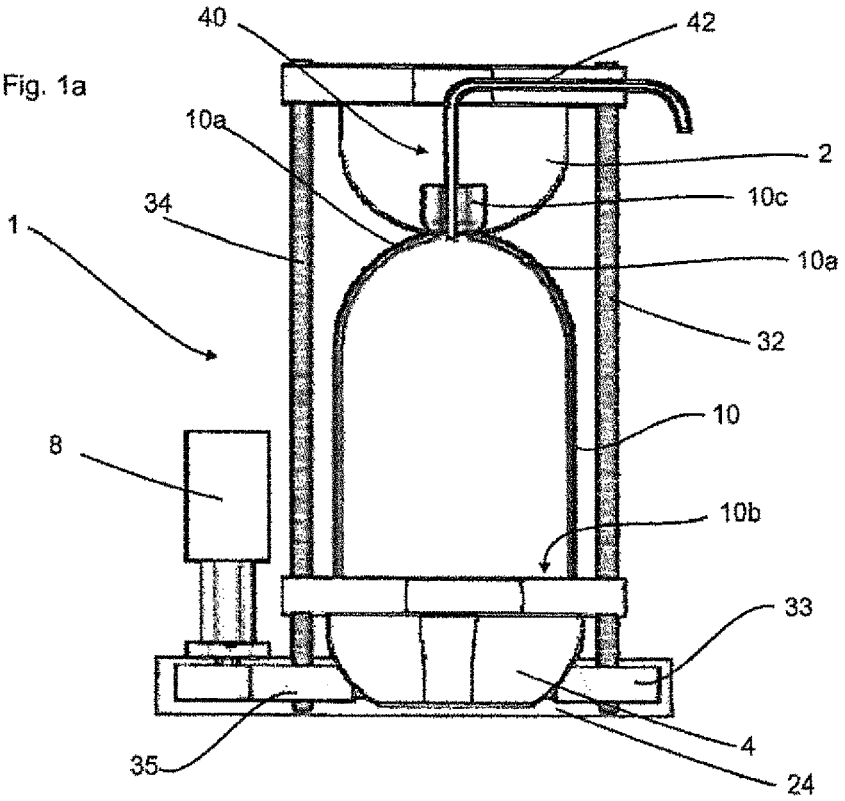
Figure 1B:
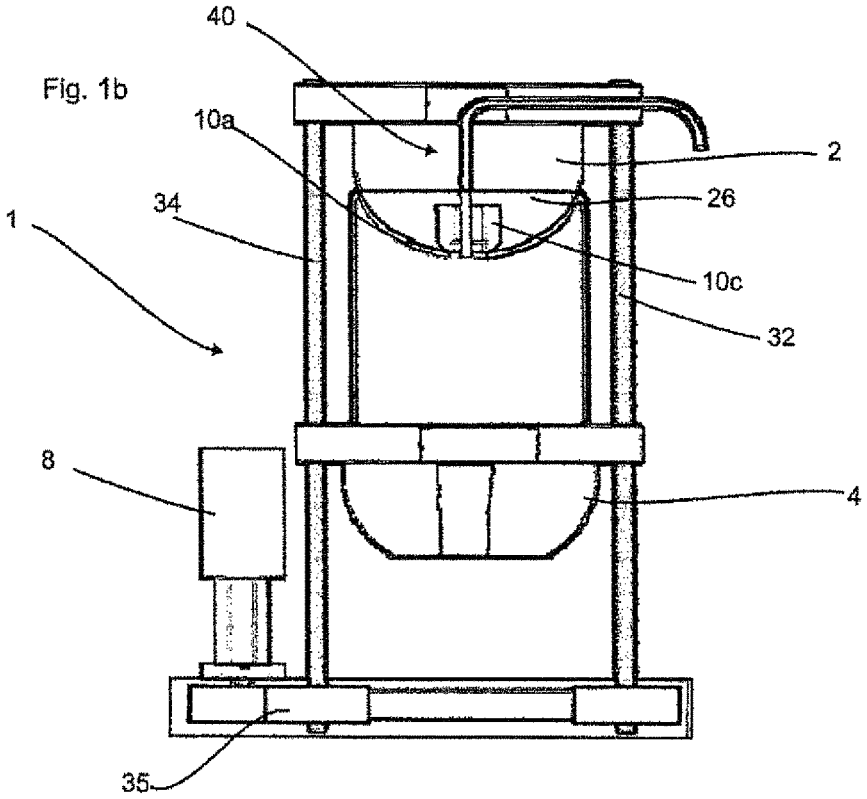
Figure 1C:
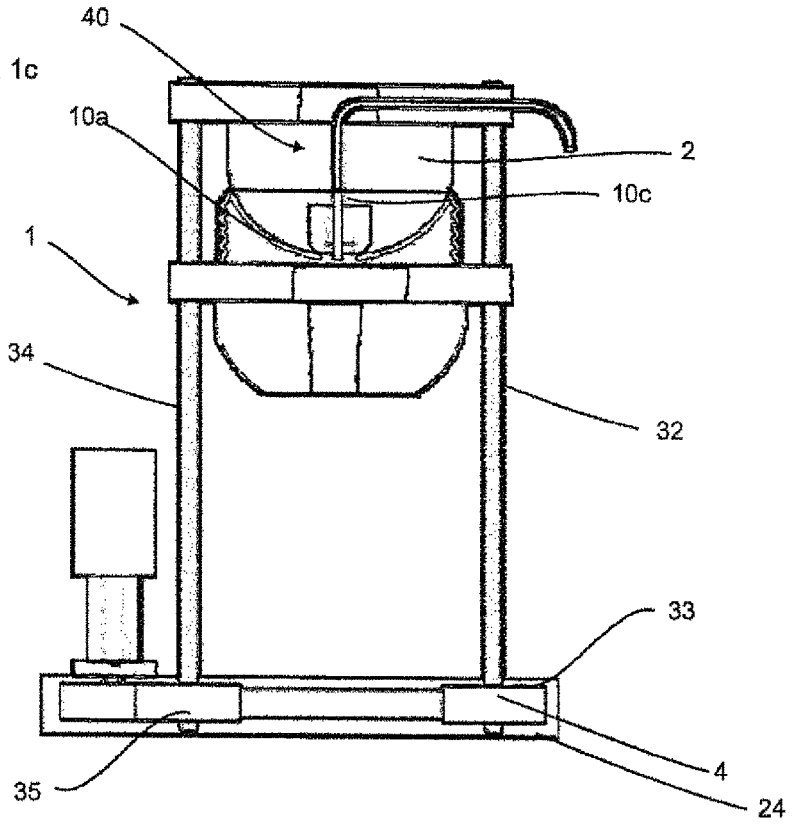

FIGS. 1*a* to 1*c* show three side views of an apparatus 1 according to embodiments of the invention. Here, a container 10 is provided which is arranged between a first holding device 2 and a second holding device 4. The holding device 2 serves to hold a mouth region 10*a* of the container including a cap 10*c* of the container, and the holding device 4 serves to hold a base region 10*b* (this is hidden). In order to withdraw liquid, the second holding device 4 is moved upwards and thus towards the first holding device 2. In this way, liquid can be withdrawn from the container via a withdrawal device 40, which in particular has a withdrawal hose 42. References 32 and 34 denote two drive spindles, the rotation of which brings about here a movement of the second holding device 4 in the upward direction. A third spindle is also provided, but this is not visible in the figures.

Reference 8 denotes a drive device, in particular a drive motor, which drives the spindles 32 and 34 here via toothed wheels 33 and 35 and a drive belt 24, which serves here as force transmission means.

FIG. 1*b* shows the apparatus of FIG. 1*a* in a further operating state. Here, the second holding device 4 is already halfway up the spindles 32 and 34 and thus the container 10 has already been partially rolled. It can be seen here that in particular the first holding device 2 has a stamp 26, the cross-section of which is smaller than a cross-section of the container, so that the mouth region having the cap 10*c* can be rolled into the container. In this way, very substantial emptying of the container is possible.

In the situation shown in FIG. 1*c*, the second holding device 4 has already been moved almost completely towards the first holding device 2 and the container has thus been almost completely emptied.

Figure 2:
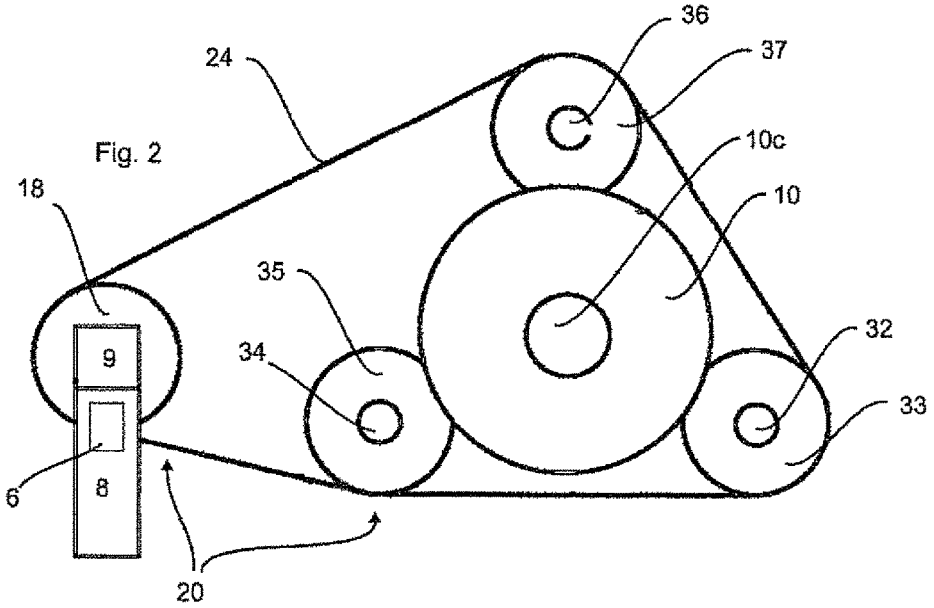
FIG. 2 shows a plan view of an apparatus.

FIG. 2 shows a plan view of an apparatus according to the invention in a first embodiment. It is once again possible to see here the container 10 having a container cap 10*c*. It is also possible to see three drive spindles 32, 34 and 36, which are respectively coupled to toothed wheels 33, 35 and 37. These toothed wheels are driven by the revolving force transmission means 24, which is embodied here as a toothed belt. Reference 8 denotes a drive device, and reference 9 denotes a gearing via which a toothed drive wheel 18 is driven, which in turn drives the force transmission means 24. In this embodiment, a torque detection may be provided within the drive device 8, for example a drive torque may be detected via a rotary encoder or also via a current measuring device which detects a current that is necessary for driving the drive device 8.

A control device can control the drive device 8 as a function of this drive torque. The control may be carried out in such a way that the drive torque (and thus also the pressure inside the container) always lie within predefined limits. Reference 6 denotes in its entirety the control device which controls the relative movement of one holding device relative to the other holding device. Preferably, this control device controls the drive device 8.

Reference 20 denotes in its entirety the movement device which serves for achieving the relative movement between the first holding device 2 and the second holding device 4. This movement device 20 preferably comprises the entire drivetrain from the actual drive device to at least one holding device, that is to say in particular including the force transmission means and the drive spindles.

Preferably, the drive torque of the drive device is determined via the effect of this drive torque on at least one element of said drivetrain.

Figure 3:
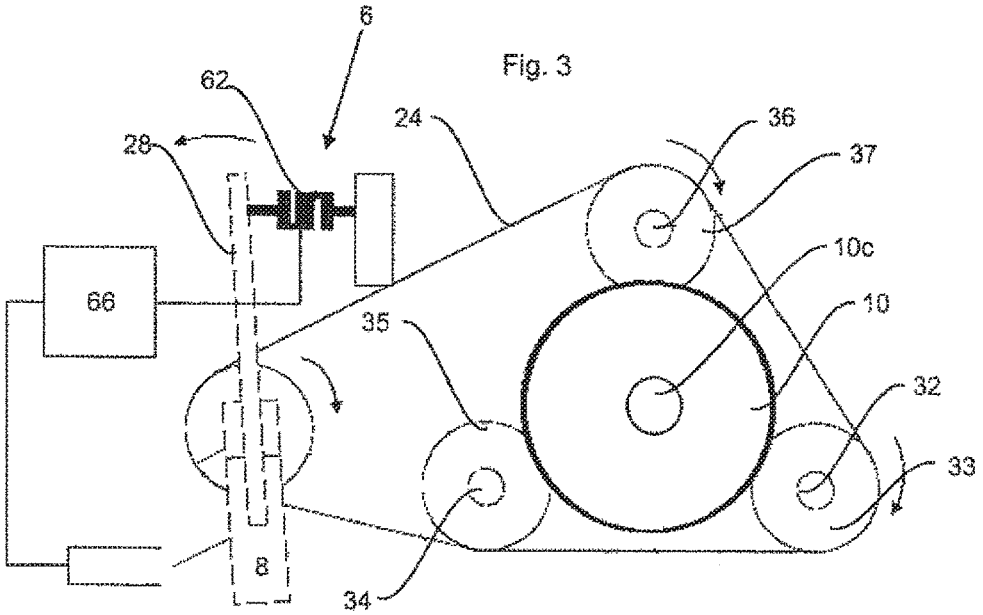
FIG. 3 shows a diagram of an apparatus in a further embodiment.

FIG. 3 shows a further embodiment of the present invention. In this embodiment, once again the three drive spindles are provided which bring about the emptying of the container and move the holding devices towards one another. In this embodiment, a force measuring device or a sensor device 62 is provided. This may be, for example, an electric force sensor, such as a piezo element or a strain gauge. Reference 28 denotes a carrier, by means of which the drive device 8 is mounted here in a pivotable manner. When the drive torque or the force necessary to compress the container increases, this carrier 28 would pivot to the left, as illustrated by the arrow, and accordingly would load the force measuring device 62. Reference 66 denotes a regulating device which regulates the motor or the drive device 8 as a function of a signal output by the force measuring device 62. The elements described here represent in their entirety the control device 6.

Figure 4:
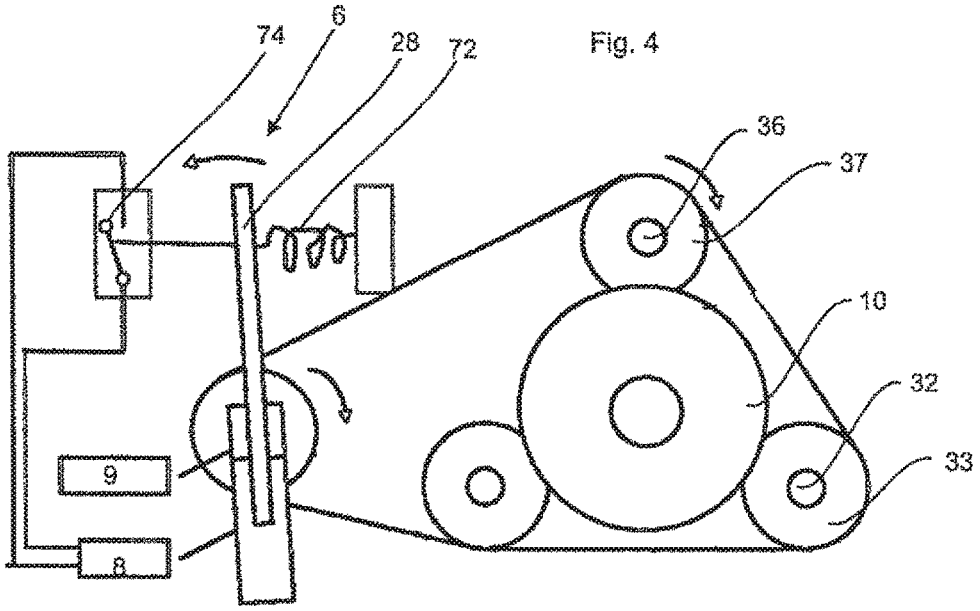
FIG. 4 shows a diagram of an apparatus in a further embodiment.

FIG. 4 shows a further embodiment of the apparatus according to the invention, wherein here a relatively simple force switch is provided. First, a spring device 72 is provided which biases the carrier 28 counter to the arrow direction in FIG. 4, that is to say to the right. When the drive torque increases, the carrier 28 will once again pivot to the left and in this case can trigger a switching device 74 and thus for example stop the drive device 8. As soon as the drive torque decreases again, the switch 74 can be closed again and the motor will again be actuated.

Within the context of experiments carried out by the applicant, use was made of an electric force sensor having a measurement range between 0 and 2 kN. The lever length of the carrier 28 was selected as 10 mm. The three spindles 32, 34 and 36 compress the container 10, wherein a pitch of the spindles is advantageously between 2 mm and 10 mm, particularly preferably between 3 mm and 8 mm and particularly preferably between 4 mm and 6 mm. The drive takes place here, as shown, via the force transmission device or the toothed belt 28 without any further gear reduction. In this way, for different pressures inside the container, the torque was determined for maintaining the pressure in the container on the one hand and on the other hand for increasing said pressure or for maintaining the pressure when pressing against an overpressure valve.

Due to the efficiency of the spindles and the resistance when pressing against an overpressure valve (which corresponds to the dispensing), these values differ, which in turn leads to a hysteresis effect. This hysteresis effect is useful so that the drive device 8 does not switch on and off as frequently. Therefore, as mentioned above, the pressure inside the container is also determined and/or regulated by means of a torque on the drive spindles 32, 34, 36 and/or the drive device. Preferably, as mentioned above, an electrically measuring force measurement system is provided, which is used for evaluation and regulation purposes.

Overall, this is a very simple and accurate method for measuring the container pressure or for controlling the drive device as a function of the container pressure, without making contact with the product itself. This effect can also be used for safety reasons in a dispensing system so that, due to a maximally achievable torque, the container pressure can never rise above a bursting pressure. Different methods are conceivable for limiting the torque of the drive device, both electrical and electronic methods and also the embodiments shown in FIG. 3 or 4.

FIGS. 5*a* and 5*b* schematically show the relationships between the measured force and the container pressure. The force and thus the torque necessary for rolling the container under pressure and for maintaining the pressure within the rolled container can be determined at a measuring device, for example the measuring device 62 (cf. FIG. 3). Here, the tensile force (FZ) on the container can be obtained as follows:

$$FZ=(M*2*\pi):(S*\eta)$$

Here, M denotes the torque, S denotes the spindle pitch and $\eta$ denotes the spindle efficiency.

FIG. 5*a* shows the relationship between the container pressure and the torque. The left-hand diagram shows the relationships for the holding torque and the right-hand diagram 5*b* shows the relationships for the force on the container. From the values measured by the measuring device 62, for example voltage values, it is possible to deduce a force, and from this force it is in turn possible to deduce a torque, and from the torque it is in turn possible to deduce the force on the container. It has been shown that the force when rolling the container is considerably higher than the holding force or the theoretical force. This is based on the one hand on the efficiency of the spindles and on the other hand on the force that is necessary in order to press the air through an overpressure valve in order to keep the pressure constant. In the case of the measurement, the voltage rise on the force sensor was 145 mV/bar. With such a structure, the voltage can be accurately determined to approximately 20 mV at a pressure of 2.5 bar. This corresponds to a pressure change of approximately 140 mbar at this pressure. The pressure can thus be accurately regulated to 0.14 bar using the apparatus according to the invention. This accuracy can be increased even further with an optimized torque support or an optimized carrier 28.

Although the present invention has been disclosed in the form of preferred embodiments and variations thereon, it will be understood that numerous additional modifications and variations could be made thereto without departing from the scope of the invention.

For the sake of clarity, it is to be understood that the use of "a" or "an" throughout this application does not exclude a plurality, and "comprising" does not exclude other steps or elements. The mention of a "unit" or a "module" does not preclude the use of more than one unit or module.

LIST OF REFERENCES

2 first holding device
4 second holding device
6 control device
8 drive device
9 gearing
10 container
10*a* mouth region
10*b* base region
10*c* cap
18 toothed drive wheel
20 movement device
24 drive belt
28 carrier
32, 34, 36 drive spindles
33, 35, 37 toothed wheels
40 withdrawal device
42 withdrawal hose
62 sensor device/force measuring device
66 regulating device
72 spring device
74 switching device

The invention claimed is:

1. An apparatus for emptying containers, comprising:

a first holding device which is suitable for holding a first region of a container that is to be emptied, a second holding device which is suitable for holding a second region of the container that is to be emptied, wherein the second region is at a distance from the first region, a movement device which is suitable for moving the first holding device towards the second holding device in order to compress the container located between the first holding device and the second holding device, a withdrawal device which has a flow connection to the interior of the container and via which liquid located in the container can be withdrawn as a result of compression of the container, a drive device for driving the movement device, wherein the movement device has a first drive spindle, the rotational movement of which brings about a movement of one holding device relative to the other holding device, and wherein a revolving element connects the drive device to the first drive spindle, and further wherein the detection device detects a force acting on the revolving element, a control device which controls the movement of one holding device relative to the other holding device as a function of an internal pressure inside the container, wherein the control device is configured in such a way that it controls the movement of one holding device relative to the other holding device as a function of a drive torque of the drive device, and a detection device adapted to directly detect the drive torque of the drive device acting on the movement device, wherein the detection device directly measures the drive torque instead of directly measuring the internal pressure in the container.

2. The apparatus according to claim 1, wherein the movement device has a second drive spindle and a rotational movement of the second drive spindle is coupled to the rotational movement of the first drive spindle.

3. The apparatus of claim 1, wherein the revolving element comprises at least one of a toothed belt and a revolving chain, further wherein both the drive device and the first drive spindle act on the revolving element.

4. The apparatus of claim 3, wherein the revolving element is driven by a gear.

5. The apparatus of claim 1, wherein the detection device is included in the drive device and is selected from at least one of a rotary encoder and a current measuring device.

6. The apparatus of claim 1, wherein the control device is configured to keep the drive torque and the internal pressure within predefined limits.

7. The apparatus of claim 1, wherein the movement device comprises an entire drivetrain from the drive device to at least one holding device, including the revolving element and the first drive spindle.

8. The apparatus according to claim 2, wherein the movement device has a third drive spindle, and the rotational movement of the first, second, and third drive spindles brings about a movement of one holding device relative to the other holding device.

* * * * *